United States Patent [19]

Jones

[11] 4,126,454

[45] Nov. 21, 1978

[54] IMAGING PROCESS UTILIZING CLASSIFIED HIGH SURFACE AREA CARRIER MATERIALS

[75] Inventor: Lewis O. Jones, Webster, N.Y.

[73] Assignee: Xerox Corporation, Stamford, Conn.

[21] Appl. No.: 474,489

[22] Filed: May 30, 1974

[51] Int. Cl.[2] ..... G03G 9/10; G03G 13/09

[52] U.S. Cl. ..... 96/15 D; 252/62.1 P; 427/18; 427/20; 428/407

[58] Field of Search ..... 117/17.5; 252/62.1; 96/1 R, 1 SD; 428/407; 427/18, 20

[56] References Cited

U.S. PATENT DOCUMENTS

| | | | |
|---|---|---|---|
| 2,618,552 | 11/1952 | Wise | 117/17.5 |
| 2,874,063 | 2/1959 | Greig | 252/62.1 P |
| 3,165,420 | 1/1965 | Tomanek et al. | 117/17.5 |
| 3,278,439 | 10/1966 | Blanchette et al. | 252/62.1 P |
| 3,320,169 | 5/1967 | East et al. | 252/62.1 P |
| 3,554,778 | 1/1971 | Granzow | 117/17.5 |
| 3,650,797 | 3/1972 | Tomanek | 96/1 SD |
| 3,811,880 | 5/1974 | Browning | 252/62.1 |
| 3,839,029 | 10/1974 | Berg et al. | 96/1 SD |
| 3,895,125 | 7/1975 | Tsuchiya et al. | 427/18 |

*Primary Examiner*—Ronald H. Smith
*Assistant Examiner*—Stuart D. Frenkel

[57] ABSTRACT

An electrostatographic imaging process comprising the steps of providing an electrostatoraphic imaging member having a recording surface, forming an electrostatic latent image on said recording surface, and contacting said electrostatic latent image with a developer mixture comprising finely divided toner particles electrostatically clinging to the surface of classified high surface area carrier materials having a specific surface area of at least about 150 $cm^2$/gram, a particle size volume distribution geometric standard deviation of less than about 1.3, and a particle size distribution wherein the carrier particles have an average particle diameter of less than about 100 microns, whereby at least a portion of said finely divided toner particles are attracted to and deposited on said recording surface in conformance with said electrostatic latent image.

6 Claims, No Drawings

IMAGING PROCESS UTILIZING CLASSIFIED HIGH SURFACE AREA CARRIER MATERIALS

BACKGROUND OF THE INVENTION

This invention relates in general to electrostatographic imaging systems, and, in particular, to improved developer materials and their use.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finelydivided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,522 is known as "cascade" development. In this method, developer material comprising relatively large carrier particles having finely-divided toner particles electrostatically clinging to the surface of the carrier particles is conveyed to and rolled or cascaded across the electrostatic latent imagebearing surface. The composition of the toner particle is so chosen as to have a triboelectric polarity opposite that of the carrier particles. In order to develop a negatively charged electrostatic latent image, an electroscopic powder and carrier combination should be selected in which the powder is triboelectrically positive in relation to the carrier. Conversely, to develop a positively charged electrostatic latent image, the electroscopic powder and carrier should be selected in which the powder is triboelectrically negative in relation to the carrier. This triboelectric relationship between the powder and carrier depends on their relative positions in a triboelectric series in which the materials are arranged in such a way that each material is charged with a positive electrical charge when contacted with any material below it in the series and with a negative electrical charge when contacted with any material above it in the series. As the mixture cascades or rolls across the image-bearing surface, the toner particles are electrostatically deposited and secured to the charged portions of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographid development technique. A general purpose office copying machine incorporating this technique is described in U.S. Pat. No. 3,099,943.

Another technique for developing electrostatic images is the "magnetic brush" process as disclosed, for example, in U.S. Pat. No. 2,874,063. In this method a developer material containing toner and magnetic carrier particles is carried by a magnet. The magnetic field of the magnet causes alignment of the magnetic carriers in a brush-like configuration. This "magnetic brush" is engaged with an electrostatic latent imagebearing surface and the toner particles are drawn from the brush to the electrostatic image by electrostatic attraction. Many other methods such as "touchdown" development as disclosed by C. R. Mayo in U.S. Pat. No. 2,895,847 are known for applying electroscopic particles to the electrostatic latent image to be developed. The development processes as mentioned above together with numerous variations are well known to the art through various patents and publications and through the widespread availability and utilization of electrostatographic imaging equipment.

In automatic electrostatographic equipment, it is conventional to employ an electrostatographic plate in the form of a cylindrical drum which is continously rotated through a cycle of sequential operations including charging, exposure, developing, transfer and cleaning. The plate is usually charged with corona with positive polarity by means of a corona generating device of the type disclosed by L. E. Walkup in U.S. Pat. No. 2,777,957 which is connected to a suitable source of high potential. After forming a powder image on the electrostatic image during the development step, the powder image is electrostatically transferred to a support surface by means of a corona generating device such as the corona device mentioned above. In automatic equipment employing a rotating drum, a support surface to which a powdered image is to be transferred is moved through the equipment at the same rate as the periphery of the drum and contacts the drum in the transfer position interposed between the drum surface and the corona generating device. Transfer is effected by the corona generating device which imparts an electrostatic charge to attract the powder image from the drum to the support surface. The polarity of charge required to effect image transfer is dependent upon the visual form of the original copy relative to the reproduction and the electroscopic characteristics of a developing material employed to effect development. For example, where a positive reproduction is to be made of a positive original, it is conventional to employ a positive polarity corona to effect transfer of a negatively charged toner image to the support surface. When a positive reproduction from a negative original is desired, it is conventional to employ a positively charged developing material which is repelled by the charged areas on the plate to the discharge areas thereon to form a positive image which may be transferred by negative polarity corona. In either case, a residual powder image and occasionally carrier particles remain on the plate after transfer. Before the plate may be reused for a subsequent cycle, it is necessary that the residual image and carrier particles, if any, be removed to prevent ghost images from forming on subsequent copies. In the positive-to-positive reproduction process described above, the residual developer powder as well as any carrier particles present are tightly retained on the plate surface by a phenomenon that is not fully understood but believed caused by an electric charge. The charge is substantially neutralized by means of a corona generating device prior to contact of the residual powder with a cleaning device. The neutralization of a charge enhances the cleaning efficiency of the cleaning device. Typical electrostatographic cleaning devices include the "web" type cleaning apparatus as disclosed, for example, by W. P. Graff, Jr. et al in U.S. Pat. No. 3,186,838. In the Graff, Jr. et al patent, removal of the residual powder and carrier particles on the plate is effected by rubbing a web of fibrous material against the imaging plate surface. These inexpensive and disposable webs of fibrous material are advanced into pressure and rubbing or wiping contact with the imaging surface and are gradually advanced to present a clean surface to the plate whereby substantially complete removal of the residual powder and carrier particles from the plate is effected.

While ordinarily capable of producing good quality image, conventional developing systems suffer serious deficiencies in certain areas. In the reproduction of high contrast copies such as letters, tracings and the like, it is desirable to select the electroscopic powder and carrier materials so that their mutual electrification being governed in most cases by the distance between their relative positions in the triboelectric series. However, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the toner particles. Although the image density described in the immediately preceding sentence may be improved by increasing the toner concentration in the developer mixture, undesirably high background toner deposition as well as increased toner impaction and agglomeration is encountered when the toner concentration in the developer mixture is excessive. The initial electrostatographic plate charge many be increased to improve the density of the deposited powder image, but the plate charge would ordinarily have to be excessively high in order to attract the electroscopic powder away from the carrier particle. Excessively high electrostatographic plate charges are not only undesirable because of the high power consumption necessary to maintain the electrostatographic plate at high potentials, but also because the high potential causes the carrier particles to adhere to the electrostatographic plate surface rather than merely roll across and off the electrostatographic plate surface. Print deletion and massive carryover of carrier particles often occur when carrier particles adhere to reusable electrostatographic imaging surfaces. Massive carrier carry-over problems are particularly acute when the developer is employed in solid area coverage machines where excessive quantities of toner particles are removed from carrier particles thereby leaving many carrier particles substantially bare of toner particles. Further, adherence of carrier particles to resuable electrostatographic imaging surfaces promotes the formation of undesirable scratches on the surfaces during image transfer and surface cleaning operations. It is therefore, apparent that many materials which otherwise have suitable properties for employment as carrier particles are unsuitable because they possess unsatisfactory triboelectric properties. In addition, uniform triboelectric surface characteristics of many carrier surfaces are difficult to achieve with mass production techniques. Quality images are in some instances almost impossible to obtain in high speed automatic machines when carriers having non-uniform triboelectric properties are employed. Although it may be possible to alter the triboelectric value of an insulating carrier material by blending the carrier material with another insulating material having a triboelectric value remote from the triboelectric value of the original carrier material, relatively larger quantities of additional material is necessary to alter the triboelectric value of the original carrier material. The addition of large quantities of material to the original carrier material to change the triboelectric properties thereof requires a major manufacturing operation and often undesirably alters the original physical characteristics of the carrier material. Further, it is highly desirable to control the triboelectric properties of carrier surfaces to accommodate the use of desirable toner compositions while retaining the other desirble physical characteristics of the carrier. The alteration of the triboelectric properties of a carrier by applying a surface coating thereon is a particularly desirirable technique. With this technique, not only is it possible to control the triboelectric properties of a carrier made from materials having desirable physical characteristics, it is also possible to employ materials previously not suitable as a carrier. Thus, for example, a carrier having desirable physical properties with the exception of hardness, can be coated with a material having desirable hardness as well as other physical properties rendering the resultant product more useful as a carrier. Thus, there is a continuing need for a better electrostatographic carrier and an improved method for obtaining the same.

It is, therefore, an object of this invention to provide a carrier manufacturing technique and a resulting product which overcome the above-noted deficiencies.

It is another object of this invention to provide developer materials which have a longer developer life.

Another object of this invention is to provide developer materials which exhibit improved triboelectric and mechanical properties useful in an electrostatographic apparatus employing magnetic brush development apparatus.

It is yet another object of this invention to provide developer materials which are more resistant to film formation on electrostatographic recording surfaces.

It is another object of this invention to provide developer materials which do not tend to stick to background areas of electrostatographic imaging surfaces.

It is still further object of this invention to render suitable many materials which were heretofore unsuitable as carrier materials.

A still further object of this invention is to provide improved developer materials having physical and chemical properties superior to those of known developer materials.

The above objects and others are accomplished, generally speaking, by providing electrostatographic developer materials comprising classified carrier materials having a specific surface area of at least about 150 $cm^2$/gram.

More specifically, the improved developer materials of this invention provide satisfactory results when the carrier materials have a specific surface area of at least about 150 $cm^2$/gram. However, it is preferred that the carrier materials have a specific surface area of at least about 165 $cm^2$/gram because developer life is improved such as to provide increased copy quantity with the developer material in a high speed electrostatographic reproduction apparatus while maintaining low background levels and sustaining solid area development density. Optimum results are obtained when the carrier materials of this invention have a specific surface area of at least about 175 $cm^2$/gram.

It has been found that the area ratios of carrier to toner material in a high speed magnetic brush development system were such that the toner concentration could not be sufficiently reduced to enable a charge level for minimal deposit of toner material in background areas of an electrostatic latent image during development thereof while retaining sufficient toner concentration to provide satisfactory solid area density. By providing the carrier materials of this invention having a minimum specific surface area this problem has been overcome. Thus, this invention now enables the use of a developer mixture having a lower toner concentration per unit surface area of carrier to provide a higher net electrical charge level. It has been found that in the electrostatic copying process that where any given carrier material is employed to provide a triboelectric charge to toner materials by contact charge transfer, the area of carrier triboelectric charging surface is critically important. The carrier charging area has been found to relate to the amountof toner material that, for a given toner material, can be charged to a useful triboelectric potential or level. Therefore, in accordance with this invention, it has been found that the triboelectric charging capacity of a carrier material is surface area dependent and accordingly, this invention may be employed to design optimum carrier materials for any given electrostatographic development system.

In addition, the classified high surface area carrier materials of this invention have a particle size volume distribution geometric standard deviation of less than about 1.3 and a particle size distribution wherein the particles have an average particle size distribution wherein the particles have an average particle diameter of less than about 100 microns. The term geometric standard deviation as employed herein is defined as the deviation encountered in a particle size analysis approximately measured as the ratio of the particle diameter which is greater than that of 84 percent of the sample to that of the particle diameter which is greater than that of 50 percent of the sample. This value represents the median or average particle size. distribution by weight or volume of the carrier particles and has an important reflection on copy quality obtained in an electrostatographic development system. Another measure of the geometric standard deviation of the classified carrier materials of this invention is the deviation encountered in a particle size analysis approximately measured as the ratio of the particle diameter which is greater than that of 50 percent of the sample to that of the particle diameter which is greater than that of 16 percent of the sample. The 50 percent value represents the medium or average particle size by volume of the carrier particles and has an important reflection on the measure of the useful lifetime of the developer. In both cases, the values obtained for the volume average particle diameter and the geometric standard deviation are determined by size analysis performed by a sieve analysis employing all U.S. Standard Sieves from 325 mesh to 70 mesh.

It has been found that the classified carrier materials of this invention provide satisfactory results when the particle size volume distribution geometric standard deviation thereof is less than about 1.3 and the volume average particle diameter is less than about 100 microns. Improved results are obtained with, and it is preferred, that the particle size volume distribution geometric standard deviation thereof be less than about 1.2 and the volume average particle diameter is less than about 90 microns. Optimum results are obtained when the volume distribution geometric standard deviation of the classified carrier materials of this invention is less than about 1.15 and the volume average particle diameter is less than about 85 microns.

Any suitable particle classification method may be employed to obtain the high surface area carrier materials of this invention. Typical particle classification methods include air classification, screening, cyclone separation, elutriation, centrification, and combinations thereof. The preferred method of obtaining the high surface area carrier materials of this invention is by screening or seiving.

Any suitable coated or uncoated electrostatographic carrier bead material may be employed as the high surface area carrier material of this invention. Typical cascade development process carriers include sodium chloride, ammonium chloride, aluminum potassium chloride, Rochelle salt, sodium nitrate, aluminum nitrate, potassium chlorate, granular zircon, granular silicon, methyl methacrylate, glass and silicon dioxide. Typical magnetic brush development process carriers include nickel, steel, iron, ferrites, and the like. The carriers may be employed with or without a coating. Many of the foregoing and other typical carriers are described by L. E. Walkup et al in U.S. Pat. No. 2,638,416 and E. N. Wise in U.S. Pat. No. 2,618,552. An ultimate coated carrier particle diameter between about 30 microns to about 1,000 microns is preferred because the carrier particles then possess sufficient density and inertia to avoid adherence to the electrostatic images during the cascade development process. For magnetic brush development, the carrier particles generally have an average diameter between about 30 microns and about 250 microns. Generally speaking, satisfactory results are obtained when about 1 part toner is used with about 10 to 200 parts by weight of carrier.

The high surface area carrier materials of this invention may be coated with any suitable coating material. Typical electrostatographic carrier particle coating materials include vinyl chloride-vinyl acetate copolymers, styrene-acrylate-organosilicon terpolymers, natural resins such as caoutchouc, colophony, copal, dammar, Drangon's Blood, jalap, storax; thermoplastic resins including the polyolefins such as polyethylene, polypropylene, chlorinated polyethylene, and chlorosulfonated polyethylene; polyvinyls and polyvinylidenes such as polystyrene, polymethylstyrene, polymethyl methacrylate, polyacrylonitrile, polyvinyl acetate, polyvinyl alcohol, polyvinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates; thermosetting resins including phenolic resins such as phenol-formalidehyde, phenol-furfural and resorcinol formaldehyde; amino resins such as urea-formaldehyde and melamineformaldehyde; polyester resins; epoxy resins; and the like. Many of the foregoing and other typical carrier coating materials are described by L. E. Walkup in U.S. Pat. No. 2,618,551; B. B. Jacknow et al in U.S. Pat. No. 3,526,533; and R. J. Hagenbach et al in U.S. Pat. Nos. 3,533,835 and 3,658,500.

When the high surface area carrier materials of this invention are coated, any suitable electrostatographic carrier coating thickness may be employed. However, a carrier coating having a thickness at least sufficient to form a thin continuous film on the carrier particle is preferred because the carrier coating will then possess sufficient thickness to resistabrasion and prevent pinholes which adversely affect the triboelectric properties of the coated carrier particles. Generally, for cascade and magnetic brush development, the carrier coating may comprise from about 0.1 percent to about 10.0 percent by weight based on the weight of the coated carrier particles. Preferably, the carrier coating should comprise from about 0.3 percent to about 1.5 percent by weight based on the weight of the coated carrier particles because maximum durability, toner impaction resistance, and copy quality are achieved. To achieve further variation in the properties of the coated composition carrier particles, wellknown additives such as plasticizers, reactive and non-reactive polymers, dyes, pigments, wetting agents and mixtures thereof may be mixed with the coating materials.

When the high surface area carrier materials of this invention are coated, the carrier coating composition may be applied to the carrier cores by any conventional method such as spraying, dipping, fluidized bed coating, tumbling, brushing and the like. The coating compositions may be applied as a powder, a dispersion, solution, emulsion or hot melt. When applied as a solution, any suitable solvent may be employed. Solvents having relatively low boiling points are preferred because less energy and time is required to remove the solvent subsequent to application of the coating to the carrier cores. If desired, the coating may comprise resin monomers which are polymerized in situ on the surface of the cores or plastisols gelled in situ to a non-flowable state on the surface of the cores. Surprisingly, it has been found that for a given inefficient coating process, carrier core materials having the specific surface areas designated in this invention results in increased effective area, that is, triboelectric charging coated area per unit weight. Thus, increased carrier active area increases the net toner material triboelectric charge level for a given toner concentration by weight in a developer mixture. Therefore, where it is preferred to operate an electrostatographic development system at a minimum toner concentration as to provide solid area coverage and at a toner concentration high enough to minimize toner deposits in background areas of a developed electrostatic latent image resulting from toner particles having a low or weak triboelectric charge, these objectives may be attained by employing the high surface area carrier materials of this invention. In accordance with this invention, the aforementioned objectives are attained by operating at a decreased toner concentration providing lower background deposits and enabling longer developer life.

Any suitable pigmented or dyed electroscopic toner material may be employed with the high surface carriers of this invention. Typical toner materials include: gum sandarac, rosin, cumaroneindene resin, asphaltum, gilsonite, phenol-formaldehyde resins, methacrylic resins, polystyrene resins, polypropylene resins, epoxy resins, polyethylene resins, and mixtures thereof. The particular toner material to be employed obviously depends upon the separation of the toner particles from the high surface area carrier beads in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. Reissue No. 25,136 to Carlson and U.S. Pat. No. 2,788,288 to Rheinfrank et al. These toners generally have an average particle diameter between about 1 and about 30 microns.

Any suitable toner concentration may be employed with the high surface area carriers of this invention. Typical toner concentrations for cascade and magnetic brush development systems include about 1 part toner with about 10 to about 400 parts by weight of carrier.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Greene Ozalate, lampblack, Rose Bengal, Monastral Red, Sudan Black BM, and mixtures thereof. The pigment or dye should be present in the toner in a quantity sufficient to render it highly colored so that it will form a clearly visible image on a recording member. Preferably, the pigment is employed in an amount from about 3 percent to about 20 percent, by weight, based on the total weight of the colored toner because high quality images are obtained. If the toner colorant employed is a dye, substantially smaller quantities of colorant may be used.

Any suitable organic or inorganic photoconductive material may be employed as the recording surface with the high surface area carriers of this invention. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric oxide, mercuric sulfide, indium trisulfide, gallium selenide, arsenic disulfide, arsenic trisulfide, arsenic triselenide, antimony trisulfide, cadmium sulfo-selenide and mixtures thereof. Typical organic photoconductors include: guinacridone pigments, phthalocyanine pigments, triphenylamine, 2,4-bix(4,4'-diethylaminophenol) -1, 3,4,-oxadiazol, N-isopropylcarbazol, triphenylpyrrol, 4,5-diphenylimidazolidinone, 4,5-diphenyl-imidazolidinethione, 4,5-bix(4'-amino-phenyl)-imidazolidinone, 1,5-dicyanonaphthalene, 1,4-dicyanonaphthalene, aminophthalodinitrile, nitrophthalodinitrile, 1,2,5,6-tetraazacyclooctatetraene-(2,4,6,8), 2-mercaptobenzothiazole-2-phenyl-4-diphenylideneoxazolone, 6-hydroxy-2,3-di(p-methoxypenyl)-benzofurane, 4-dimethylaminobenzylidene-benzhydrazide, 3-benzylidene-aminocarbazole, polyvinyl carbazole, (2-nitro-benzylidene)-p-bromoaniline, 2,4-diphenylquinazoline, 1,2,4-triazine, 5-diphenyl-3-methyl-pyrazoline,2-(4'dimethylamino phenyl)-benzoxazole, 3-aminecarbazole, and mixtures thereof. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The following examples further define, describe and compare methods of preparing the carrier materials of the present invention and of utilizing them to develop electrostatic latent images. Parts and percentages are by/weight unless otherwise indicated.

EXAMPLE I

A control developer mixture is prepared by mixing about 1 part of toner material comprising a styrene-n-butyl methacrylate copolymer, polyvinyl butyral, and carbon black produced by the method disclosed in Example I of U.S. Pat. No. 3,079,342 having an average particle size of about 10 to about 20 microns with about 100 parts of a carrier core material comprising nickel-zinc ferrite coated with about 0.6% by weight, based on the weight of the core material, of a carrier coating composition comprising styrene, a methacrylate ester, and an organosilicon compound as disclosed in U.S. Pat. No. 3,526,533. The coated ferrite carrier material is determined by seive analysis to have a particle size distribution as follows:

| U. S. Sieve | % by Weight |
|---|---|
| 70 mesh (210μ) | 0 |
| 80 mesh (177μ) | 0 |
| 100 mesh (149μ) | .1 |
| 120 mesh (125μ) | .1 |
| 140 mesh (105μ) | 7.2 |
| 170 mesh ( 88μ) | 30.4 |
| 200 mesh ( 74μ) | 30.7 |
| 230 mesh ( 63μ) | 25.5 |
| 270 mesh ( 54μ) | 5.7 |
| 325 mesh ( 44μ) | 0.2 |
| Pan | 0 |

By calculation, the coated ferrite carrier material is determined to have a specific surface area of about 128 $cm^2$/gram. The developer mixture is used to develop a selenium photoconductor recording surface bearing an electrostatic latent image by the "magnetic brush" development method described in U.S. Pat. No. 2,874,063. The magnetic field of the magnet causes alignment of the carrier and toner into a brush-like configuration. The magnetic brush is brought into developing configuration with the electrostatic imagebearing surface and toner particles are drawn from the carrier particles to the latent image by electrostatic attraction. The resultant copies of a standard image test pattern are of good quality up to about 25,000 copies when the image background level is found to exceed the maximum value of 0.010 which is deemed acceptable.

EXAMPLE II

A developer mixutre is prepared by mixing about 1 part of the toner material employed in Example I with about 100 parts of the carrier material employed in Example I except that the carrier material was determined by seive analysis to have the following particle size distribution:

| U. S. Seive | % By Weight |
|---|---|
| 70 Mesh (210μ) | 0 |
| 80 Mesh (177μ) | 0 |
| 100 Mesh (149μ) | 0.8 |
| 120 Mesh (125μ) | 5.9 |
| 140 Mesh (105μ) | 21.4 |
| 170 Mesh ( 88μ) | 40.3 |
| 200 Mesh ( 74μ) | 28.5 |

-continued

| U. S. Seive | % By Weight |
|---|---|
| 230 Mesh ( 63μ) | 1.4 |
| 270 Mesh ( 54μ) | 1.4 |
| 325 Mesh ( 44μ) | 0.3 |
| Pan | 0 |

By calculation, the coated ferrite carrier material is determined to have a specific surface area of about 151 $cm^2$/gram. The developer is used to develop a selenium photoconductor recording surface bearing an electrostatic latent image under substantially the same conditions as in Example I. It is found that the resultant copies of the standard image test pattern are of good quality up to about 70,000 copies when the image background level is found to be about the maximum value of 0.010 deemed acceptable.

EXAMPLE III

A developer mixture is prepared by mixing about 1 part of the toner material employed in Example I with about 100 parts of the carrier materal employed in Example I except that the carrier material was determined by seive analysis to have the following particle size distribution:

| U. S. Seive | % By Weight |
|---|---|
| 70 Mesh (210μ) | 0 |
| 80 Mesh (177μ) | 0 |
| 100 Mesh (149μ) | 0 |
| 120 Mesh (125μ) | 0.16 |
| 140 Mesh (105μ) | 13.8 |
| 170 Mesh ( 88μ) | 35.1 |
| 200 Mesh ( 74μ) | 40.9 |
| 230 Mesh ( 63μ) | 7.59 |
| 270 Mesh ( 54μ) | 1.86 |
| 325 Mesh ( 44μ) | .53 |
| Pan | 0.06 |

By calculation, the coated ferrite carrier material is determined to have a specific surface area of about 160 $cm^2$/gram. The developer is used to develop a selenium photoconductor recording surface bearing an electrostatic latent image under substantially the same conditions as in Example I. It is found that the resultant copies of the standard image test pattern are good quality up to about 100,000 copies when the image background level is found to be about the maximum value of 0.010 deemed acceptable.

EXAMPLE IV

A developer mixture is prepared by mixing about 1 part of the toner material employed in Example I with about 100 parts of the carrier material employed in Example I except that the carrier material was determined by seive analysis to have the following particle size distribution:

| U. S. Seive | % By Weight |
|---|---|
| 70 Mesh (210μ) | 0 |
| 80 Mesh (177μ) | 0 |
| 100 Mesh (149μ) | 0 |
| 120 Mesh (125μ) | 0 |
| 140 Mesh (105μ) | 5.7 |
| 170 Mesh ( 88μ) | 44.7 |
| 200 Mesh ( 74μ) | 34.9 |
| 230 Mesh ( 63μ) | 10.9 |
| 270 Mesh ( 54μ) | 3.7 |
| 325 Mesh ( 44μ) | .13 |
| Pan | 0 |

By calculation, the coated ferrite carrier material is determined to have a specific surface area of about 168 $cm^2$/gram. The developer is used to develop a selenium photoconductor recording surface bearing an electrostatic latent image under substantially the same conditions as in Example I. It is found that the resultant copies of the standard image test pattern are good quality up to about 130,000 copies when the image background level is found to be about the maximum value of 0.010 deemed acceptable.

EXAMPLE V

A developer mixture is prepared by mixing about 1 part of the toner material employed in Example I with about 100 parts of the carrier material employed in Example I except that the carrier material was determined by seive analysis to have the following particle size distribution:

| U. S. Seive | % By Weight |
|---|---|
| 70 Mesh (210μ) | 0 |
| 80 Mesh (177μ) | .2 |
| 100 Mesh (149μ) | 1.7 |
| 120 Mesh (125μ) | 4.5 |
| 140 Mesh (105μ) | 7.5 |
| 170 Mesh ( 88μ) | 10.3 |
| 200 Mesh ( 74μ) | 62.4 |
| 230 Mesh ( 63μ) | 2.6 |
| 270 Mesh ( 54μ) | 5.1 |
| 325 Mesh ( 44μ) | 5.1 |
| Pan | .51 |

This distribution was reconstructed artificially and does not satisfy a log-normal plot for a geometric standard deviation calculation. By calculation, the coated ferrite carrier material is determined to have a specific surface area of about 177 $cm^2$/gram. The developer is used to develop a selenium photoconductor recording surface bearing an electrostatic latent image under substantially the same conditions as in Example I. It is found that the resultant copies of the standard image test pattern are good quality up to about 150,000 copies when the image background level is found to be about 0.008 and still well within the maximum value of 0.010 deemed acceptable. The test was terminated at this copy count level.

Thus, the high surface area carried materials of this invention are characterized as providing improved copy quality experienced in reduced toner deposits in background areas. In addition, the high surface area carried materials of this invention are further characterized as resulting in improved machine performance with longer systems life, that is, these carrier materials provide substantially improved triboelectric charging properties of the developer mixtures for substantially longer periods of time thereby increasing the developer life of the developer mixtures and decreasing the time intervals between replacement of the developer materials. Further still, the high surface area carrier materials of this invention may be characterized as providing dense toner images and are particularly useful in magnetic brush development systems. Thus, by providing the developer materials of this invention, substantial improvements is systems life due to intrinsic developer life result upon the classification and use of carrier materials having the specified surface areas.

Although specific materials and conditions are set forth in the above examples of making and using the developer materials of this invention, these are merely intended as illustrations of the present invention. These and other high surface area carrier materials, toner materials, substitutents, and processes, such as those listed above, may be substituted for those in the Examples with similar results.

Other modifications of the present invention will occur to those skilled in the art upon a reading of the present disclosure. These are intended to be included within the scope of this invention.

What is claimed is:

1. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of classified high surface area carrier materials having a specific surface area of at least about 150 $cm^2$/gram, a particle size volume distribution geometric standard deviation of less than about 1.3, and a particle size distribution wherein the carrier particles have an average particle diameter of less than about 100 microns, said carrier materials comprising nickel-zinc ferrite coated with a thin continuous film of a coating composition comprising styrene, a methacrylate ester, and an organosilicon compound, whereby at least a portion of said finelydivided toner particles are attracted to and deposited on said recording surface in conformance with said electrostatic latent image.

2. An electrostatographic imaging process according to claim 1 wherein said carrier materials have a specific surface area of at least about 165 $cm^2$/gram.

3. An electrostatographic imaging process according to claim 1 wherein said carrier materials have a specific surface area of at least about 175 $cm^2$/gram.

4. An electrostatographic imaging process according to claim 1 wherein said carrier materials have a particle size volume distribution geometric standard deviation of less than about 1.2 and a volume average particle diameter of less than about 90 microns.

5. An electrostatographic imaging process according to claim 1 wherein said carrier materials have a volume distribution geometric standard deviation of less than about 1.15 and a volume average particle diameter of less than about 85 microns.

6. An electrostatographic imaging process according to claim 1 wherein said coating composition comprises from about 0.1 percent to about 10.0 percent by weight based on the weight of the coated carrier particles.

* * * * *